US009184529B2

(12) United States Patent
Ulrich et al.

(10) Patent No.: US 9,184,529 B2
(45) Date of Patent: Nov. 10, 2015

(54) ELECTRIC CONTACT SPRING, ELECTRIC SPRING CONTACT DEVICE AS WELL AS ELECTRIC CONTACT ZONE

(71) Applicant: Tyco Electronics AMP GmbH, Bensheim (DE)

(72) Inventors: Harald Ulrich, Fischbactal (DE); Volker Seipel, Bensheim (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 14/176,430

(22) Filed: Feb. 10, 2014

(65) Prior Publication Data

US 2014/0220831 A1 Aug. 7, 2014

Related U.S. Application Data

(63) Continuation of application No. PCT/EP2012/065345, filed on Aug. 6, 2012.

(30) Foreign Application Priority Data

Aug. 9, 2011 (DE) ..... 10 2011 080 645

(51) Int. Cl.
*H01R 13/24* (2006.01)
*H01R 12/71* (2011.01)

(52) U.S. Cl.
CPC ..... *H01R 13/2428* (2013.01); *H01R 13/2442* (2013.01); *H01R 12/714* (2013.01)

(58) Field of Classification Search
CPC ..... H01R 12/714; H01R 13/2442; H01R 13/2428
USPC ..... 439/700, 81, 500, 66, 589, 862
See application file for complete search history.

(56) References Cited

U.S. PATENT DOCUMENTS

| | | | | |
|---|---|---|---|---|
| 6,113,440 | A * | 9/2000 | Fijten et al. | 439/862 |
| 6,843,688 | B2 * | 1/2005 | Matsunaga et al. | 439/630 |
| 7,278,892 | B1 * | 10/2007 | Chien et al. | 439/862 |
| 7,381,086 | B1 * | 6/2008 | Gilmore et al. | 439/500 |
| 7,871,290 | B2 * | 1/2011 | Lou | 439/500 |
| 2001/0012734 | A1 | 8/2001 | Nishimatsu | |
| 2006/0079136 | A1 | 4/2006 | Wei | |
| 2007/0178719 | A1 | 8/2007 | Mendenhall et al. | |
| 2010/0136855 | A1 | 6/2010 | Kim et al. | |

FOREIGN PATENT DOCUMENTS

| | | | |
|---|---|---|---|
| DE | 202008001018 | U1 | 7/2009 |
| EP | 0902994 | B1 | 3/1999 |
| WO | 2004055944 | A1 | 12/2003 |

OTHER PUBLICATIONS

Written Opinion of the International Searching Authority, Application No. PCT/EP2012/065345, 17 pages.
International Preliminary Report on Patentability, Application No. PCT/EP2012/065345, dated Feb. 11, 2014, 10 pages.

* cited by examiner

*Primary Examiner* — Edwin A. Leon
(74) *Attorney, Agent, or Firm* — Barley Snyder

(57) ABSTRACT

The invention relates to an electric contact spring having a resilient section, an assembly portion, and a transition portion. The resilient section includes a first resilient portion, a second resilient portion extending from the first resilient portion, and a third resilient portion extending from the second resilient portion. The assembly portion extends from the first resilient portion and includes a catch device. The transition portion extends downward from the assembly portion.

14 Claims, 7 Drawing Sheets

| | Fig. 5 | Fig. 6 | Fig. 7 (I) | Fig. 8 (I+II) | Fig. 9 (II) | Fig. 10 (II) | |
|---|---|---|---|---|---|---|---|
| Elektrischer Kontakt-abschnitt 180 | 0 | 0/+ | 0/+ | 0/+ | + | + | |
| Dritter Federabschnitt 170 | 0 | + | + | ++ | +++ | ++++ | 17 |
| Dritter Biegeabschnitt 160 | 0 | ++ | +++ | ++++ | +++++ | +++++ | |
| Zweiter Federabschnitt 150 | 0 | + | + | + | + | + | 15 |
| Zweiter Biegeabschnitt 140 | 0 | ++ | +++ | ++++ | +++ | ++ | |
| Erster Federabschnitt 130 | 0 | + | + | + | + | + | 13 |
| Erster Biegeabschnitt 120 | 0 | ++ | +++ | +++ | + | + | |
| Montageabschnitt 110 | 0 | 0 | 0/+ | 0/+ | 0 | 0 | |
| Elektrischer Kontakt-abschnitt 100 | 0 | 0 | 0 | 0 | 0 | 0 | |

Fig. 11: Mechanische Spannungen $\sigma$ der elektrischen Kontaktfeder 10

ELECTRIC CONTACT SPRING, ELECTRIC SPRING CONTACT DEVICE AS WELL AS ELECTRIC CONTACT ZONE

CROSS-REFERENCE TO RELATED APPLICATIONS

This application is a continuation of PCT International Application No. PCT/EP2012/065345 filed Aug. 6, 2012, which claims priority under 35 U.S.C. §119 to 10 2011 080 645.8, filed Aug. 9, 2011.

FIELD OF INVENTION

The invention relates to an electric contact spring contact device and, in particular, electrical spring contact device having an electric contact spring.

BACKGROUND

Electric contact springs are well known to electrically connect equipment, apparatuses, devices and/or components. For example, when two devices are mechanically connected, the electric contact springs of the one device electrically connects with a contact device of the second device. Since the electronic and electrical engineering sector requires smaller devices, electric or electronic devices are becoming increasingly compact, with an increasing number of functionalities. The contact springs and the counter-contact devices must thereby perform their function in contact spaces which are becoming smaller. In contrast, however, the requirements of the mechanical connection, for example with respect to tolerances, remain constant. That is to say, as the electric contact spaces become smaller, there are an increasing number of electric contact problems, which are exacerbated, for example, by the relaxation or ageing of the materials used and/or by temperature changes.

The electrical connection, for example, of printed circuit boards, boards, battery or accumulator packs thus presents an increasing number of problems. For example, the corresponding devices, such as electric tools, mobile telephones, cameras, computers, etc., and a large number of various associated battery or accumulator packs from different manufacturers, are subject to comparatively high levels of mechanical tolerances which is to a large extent attributable to the compatibility of the associated device with the large number of different battery or accumulator packs. These tolerances must be overcome by the relevant electric contact springs or spring contact devices and the corresponding or complementary electric counter-contact devices, taking into account relaxation and optionally an increase of the tolerances owing to intensive loading. Owing to the miniaturisation and expansion of functionalities already mentioned above, an increasing number of contact springs must be located on the same surface or in the same spatial region in modern devices.

European Patent No. EP 0902994 B1 discloses a known electric spring contact device having an integral electric contact spring which is accommodated substantially completely in a housing. An electric contact portion of the contact spring protrudes from the housing and serves to electrically contact an electric counter-contact device. The contact spring has three spring portions which are guided using three bending portions in a zig-zag manner inside the housing. In the region of the contact spring that protrudes out of the housing, the contact spring has at both transverse sides protective flaps so that no external objects can become caught between the contact spring and the housing. Furthermore, the housing has solder connections which can be inserted therein and by means of which the housing can be secured to a printed circuit board. A contact zone which is arranged horizontally with the counter-contact device allows the contact portion to expand in one direction or in an opposite direction during electrical contacting.

German Patent App. No. DE 20 2008 001 018 U1 discloses an integral electric contact spring for a bus conductor portion of a printed circuit board. The zig-zag shaped elongate contact spring is securely received between two portions of a housing of the bus conductor portion and protrudes at one end with an electric contact portion from the two-part housing. At an opposing end, the contact spring can be securely electrically connected to the printed circuit board by means of a soldering pin. The contact spring has two resilient portions which are connected by means of a resiliently rigid portion and which are each arranged by means of two bending portions in the contact spring, whereby a contact zone which is arranged horizontally with a counter-contact device allows the contact portion to expand in one direction or an opposing direction during electrical contacting.

U.S. Patent App. No. 2006/0079136 A1 discloses an integral planar electric contact spring which is guided substantially completely in a housing. An electric contact portion of the contact spring that is guided by the housing in the direction of the spring protrudes from the housing and serves to provide horizontal electrical contacting with an electric counter-contact device. The contact spring has a plurality of resiliently flexible resilient portions which are connected by means of resiliently flexible bending portions and which are guided in a partially zig-zag like manner inside the housing. The contact spring further has at the other side of the resilient and bending portions a projection which, when the contact spring is used in accordance with provisions, can be positioned on a resilient portion of the contact spring. An electrical property of the contact spring is thereby improved, which can now additionally also transport electric current and transmit electric voltage using the contact connection between the projection and the respective resilient portion.

SUMMARY

An electric contact spring is provided. The electric contact spring includes a resilient section, an assembly portion, and a transition portion. The resilient section includes a first resilient portion, a second resilient portion extending from the first resilient portion, and a third resilient portion extending from the second resilient portion. The assembly portion extends from the first resilient portion and includes a catch device. The transition portion extends downward from the assembly portion.

BRIEF DESCRIPTION OF THE DRAWINGS

The invention is explained in greater detail below with reference to embodiments with reference to the appended drawings. In the detailed Figures:

FIG. 11 is a table of the mechanical tensions which occur on/in the contact spring corresponding to FIGS. 5 to 10.

DETAILED DESCRIPTION OF THE EMBODIMENT(S)

Figure 1:
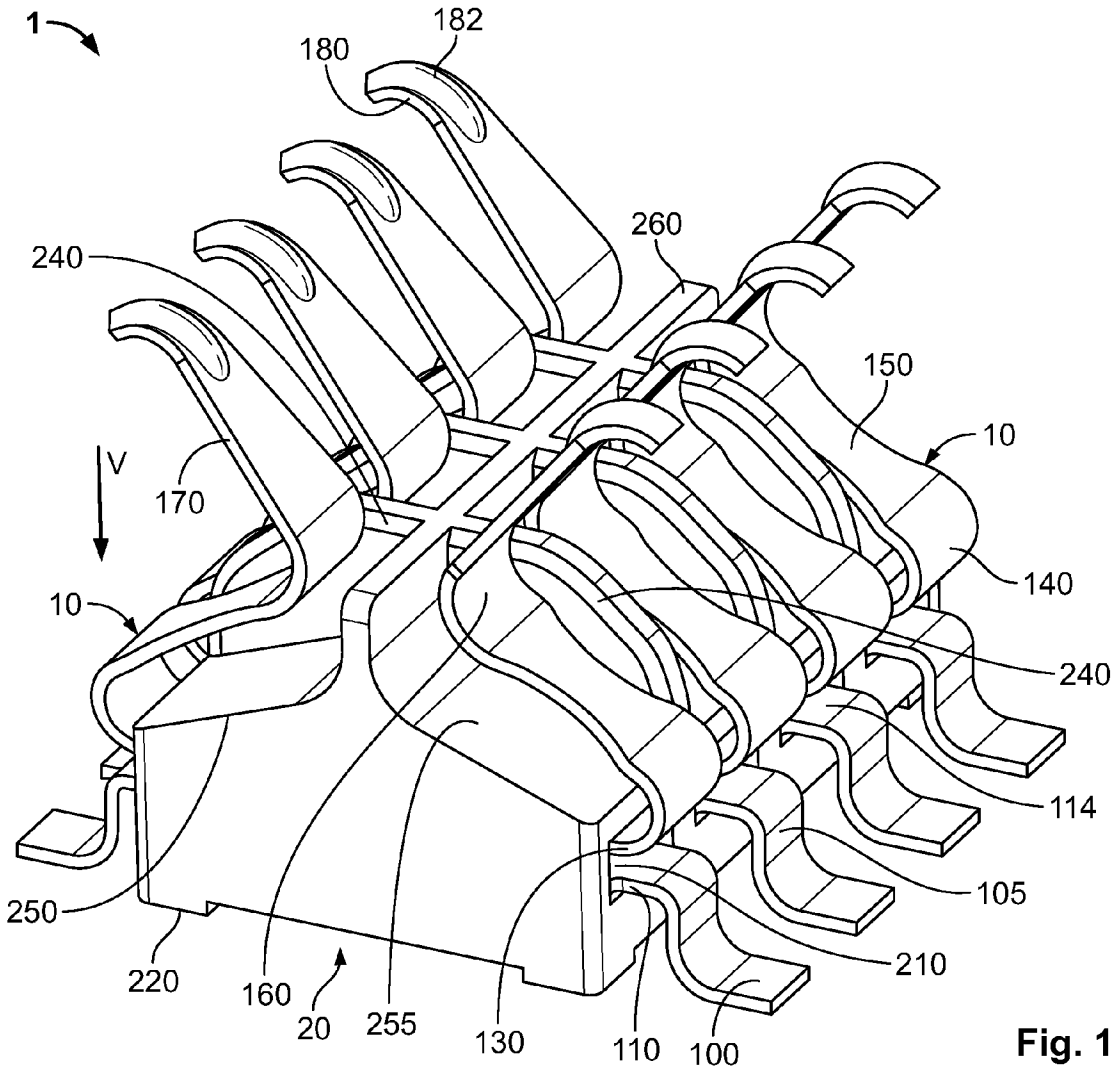
FIG. 1 is a front-end perspective view of an embodiment of an electric spring contact device according to the invention with a plurality of electric contact springs according to the invention.

The invention is explained in greater detail below with reference to an electric spring contact device 1 (connection device) for electrically contacting a printed circuit board to a housing or a housing cover having plug contacts, a carrier 20 or retention member 20 which acts as a housing 20 or inner housing 20 retaining a plurality of electric contact springs 10 or spring contacts 10; see FIG. 1.

In the shown embodiment, eight contact springs 10 are provided, with four contact springs 10 in each case being arranged opposite each other in two rows and being assembled in a mirror-symmetrical manner in the mirror-symmetrical retention member 20. However, the invention is not limited to such an application, but instead can be used on all spring contact connections in which comparatively large mechanical tolerances are intended to be overcome.

In order to compensate for a mechanical tolerance, a single electric contact spring 10 is resiliently deformable over a comparatively long extent. In the embodiment shown, there is primarily a three-stage deflection of the contact spring 10 on the retention member 20, with two stop zones I, II for two resilient portions 13, 15 of the contact spring 10 being formed when it is actuated or compressed. However, one skilled in the art should appreciate that it is possible to provide only a two-stage or a four-stage deflection of the contact spring 10 (or a greater number of stages) according to the invention on the retention member 20, that is to say, the electric spring contact device 1. The terms portion and region can be interpreted in the same manner below.

Figure 3:
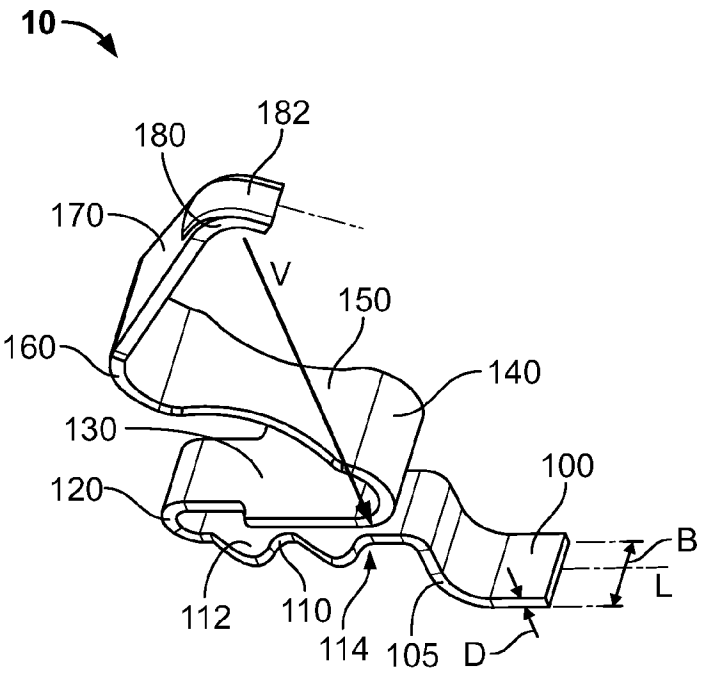
FIG. 3 is a perspective side view of a contact spring according to the invention.
Figure 2:
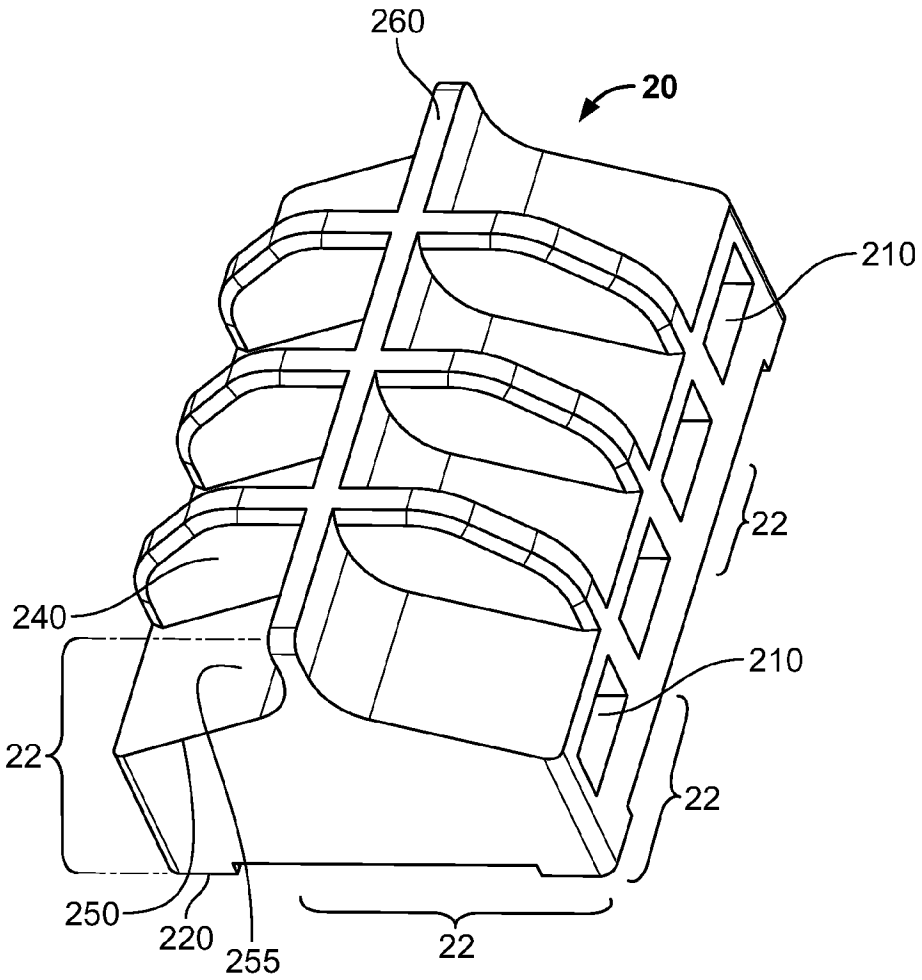
FIG. 2 is a perspective front view of a retention member of the spring contact device according to the invention.

With respect to FIG. 2 and FIG. 3 the retention member 20 and the contact spring 10 according to the invention is shown. The substantially parallelepipedal retention member 20 has at both longitudinal sides thereof a plurality of inwardly protruding receiving spaces 210 (see also FIGS. 1 and 12) which are arranged in one plane and parallel with each other, the receiving spaces 210 of each longitudinal side arranged with the same spacing with respect to each other. The contact springs 10 can be mounted in the receiving spaces 210 using an assembly portion 110 (see below) having a catch device 112, such as a plurality of catch hooks. As can be seen clearly in FIGS. 1 and 12, the contact springs 10 and retention member 20 are shaped in such a manner that the contact springs 10 extend out of their respective assembly recesses 210 and extend over an upper side of the retention member 20. That is to say, the contact springs 10 are resiliently movable above the retention member 20.

The retention member 20 may include a rib 260 which extends in the longitudinal direction of the retention member 20 along a centre line, the rib 260 structuring the retention member 20 in two lateral regions for a plurality of contact springs 10, respectively. Furthermore, the retention member 20 includes a plurality of guiding ribs 240, perpendicular relative to the rib 260, which guide at one or both sides an upper region of the contact spring 10. The retention member 20 has for n or n/2 contact springs 10 n−1 guiding ribs 240. At the top in the transverse and longitudinal direction of the retention member 20 and adjacent to the guiding ribs 240, the retention member for the contact springs 10 has outer abutment faces 250 which are each constructed in a substantially corresponding or complementary manner to a second resilient portion 150 and/or a third bending portion 160 (see below) of a contact spring 10.

The retention member 20 may have feet 220 along a lower side thereof, to position the retention member 20 on a substrate 40, for example, a printed circuit board 20, a board 20, a circuit board 20 or a punched lattice 20. In this instance, the feet 220 may serve to locate the retention member 20 on the substrate 40. However, it is also possible to use other devices for this, for example, one or more projections, which either protrude downwards from the retention member and/or protrude from the substrate 40 into the retention member 20, positive-locking recesses being used for the respective projection.

The electric spring contact device 1 is constructed in such a manner that the retention member 20, when assembled on the substrate 40, primarily or substantially receives all the forces and directs them using its mechanical connection to the substrate 40 into the substrate 40. Such forces are in particular assembly, pre-tensioning and application forces. This is carried out by the retention member 20 and an assembly position of the contact spring 10 on/in the retention member 20 and on/at the substrate 40. Furthermore, the contact spring 10 can be assembled from the outer side on/in the retention member 20 and may operate openly and externally on the retention member, whereby an extensive closed or surrounding housing can be dispensed with.

While a single electric contact spring 10 and a single relevant assembly region 22 of the contact spring 10 on/in the retention member 20, this description can be applied similarly to any number of assembly regions 22 and contact springs 10 and in any arrangement of the assembly regions 22 and contact springs 10. A single assembly region 22 is delimited by the rib 260, one or two guiding ribs 240 and the abutment face 250, the assembly region 22 being open opposite the rib 260, that is to say, in this instance the assembly region 22 is freely accessible for the contact spring 10. In this instance, the abutment face 250 is arranged in an inclined manner with respect to a base, that is to say, for example, the lower side, of the retention member 20 and merges using a radius into the rib 260.

The electric contact spring 10 includes an electric contact portion 100, a transition portion 105, the assembly portion 110, a first bending portion 120, a first resilient portion 130, a second bending portion 140, a second resilient portion 150, a third bending portion 160, a third resilient portion 170, a fourth bending portion of an electric contact portion 180. The assembly portion 110 and the resilient portions 130, 150, 170 are constructed to move back and forth above the spring base 18 using the bending portions 120, 140, 160 starting from a spring base 18 of the contact spring 10, the bending portions being arranged by a width (see FIG. 5) of the spring base 18. In this instance, the resilient portions 130, 150, 170 may be constructed as leaf springs 130, 150, 170 or resilient portions 130, 150, 170. The contact spring 10 is thereby small and/or narrow in the operational direction thereof.

The contact portion 100 serves to electrically contact the substrate 40, the contact portion 100 being constructed in particular as a soldering connection 100 having a soldering face, contact face or connection face. That is to say, the electric spring contact device 1 may be constructed as an SMD (surface mounted device). Furthermore, the contact portion 100 may also be constructed as a connection leg/pin, such as, for example, a soldering pin (not illustrated in the drawings). In this instance, the retention member 20 may not require soldering connections and the resilient contact device 1 may be mechanically secured to the substrate 40 using the contact springs 10 and to be able to be brought into electrically conductive contact with a corresponding electrical strip conductor or line.

The contact portion 180 serves to electrically contact an electric counter-contact device 60 (see FIGS. 5 to 10 and 12). The counter-contact device 60 (see FIG. 12) is a component of an electric or electronic device 6, in this instance a component of an electric or electronic apparatus 2, component 2, device 2, appliance 2, etc. The apparatus 2 includes an electric or electronic device 4, which is, for example, battery-operated or accumulator-operated. The contact portion 180, in the shown embodiment, is half-moon shape when viewed from the side may have a crimped portion 182, a projection 182, a reinforcement rib 182 or a stamped portion 182. Furthermore, the contact portion 180 may be slotted.

Figure 4:
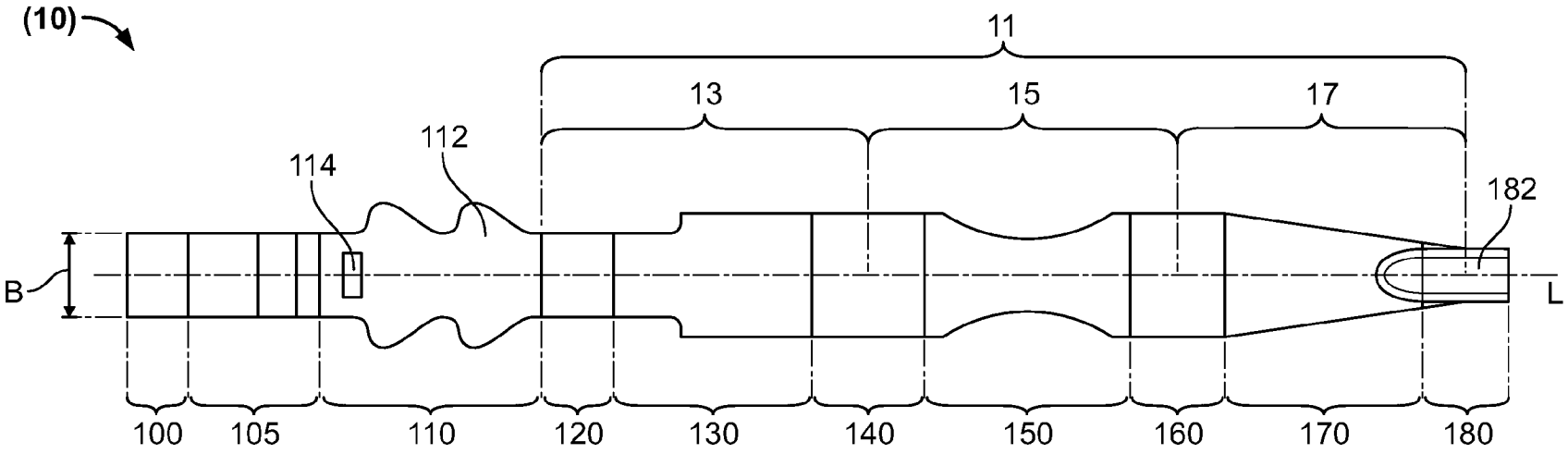
FIG. 4 is a plan view of the contact spring from FIG. 3 after being punched out from a metal sheet and before being bent into shape.
Figure 7:
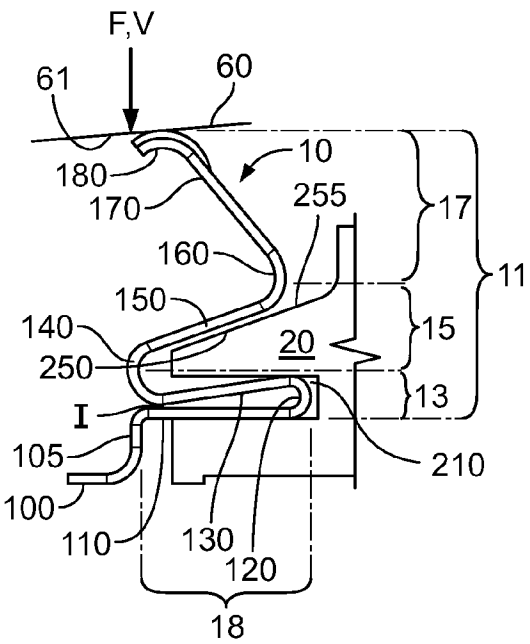
FIG. 7 is a cross section view of the spring contact device of FIG. 6, showing a first resilient portion of the contact spring coming to rest when force continues to be applied.

The electric contact spring 10 extends primarily in its longitudinal direction L, which, when the contact spring 10 is in the state bent into shape, follows the zig-zag path thereof (see FIG. 3). The contact spring 10 further has a variable width B and a constant thickness D. FIG. 4 shows the contact spring 10 in a blank state before it is bent into shape. In this instance, the electric contact portion 180 and the third resilient portion 170 may become wider in the direction of an assembly side and the second resilient portion 150 may be narrower. The first resilient portion 130 may be constructed in a stepped manner and to have a smaller width B at the assembly side. The bending portions 120, 140, 160 have a constant width B, the bending portions 140, 160 being wider than the bending portion 120.

According to the invention, an entire free resilient portion 11 (see FIGS. 4 to 10) of the shown embodiment of the contact spring 10 is subdivided into three resilient portions 13, 15, 17. A first resilient portion 13 is formed by the first bending portion 120, the first resilient portion 130 and an adjacent portion of the second bending portion 140. A second resilient portion 15 is formed by the remaining portion of the second bending portion 140, the second resilient portion 150 and an adjacent portion of the third bending portion 160. A third resilient portion 17 is formed by the remaining portion of the third bending portion 160, the third resilient portion 170 and the electric contact portion 180.

A resilient space for the contact spring 10, that is to say, a spatial region in which the resilient portion of the contact spring 10 is provided, is produced from a width of the spring base 18 together with the height of the resilient portion 11 and the width B of the contact spring 10. According to the invention, a deformation of the contact spring 10 is subdivided into a plurality of resilient portions 13, 15, 17 or resilient portions 130, 150, 170, self-adjusting stops limiting a mechanical tension σ (see FIG. 11) on/in the contact spring 10 in a specific region of the contact spring 10. There is thereby produced a current, that is to say, still available, resilient path of the contact spring 10, from a height of the resilient portions 13, 15, 17 which can still be pressed together or the resilient portions 130, 150, 170 of the contact spring 10 which can still be deflected, which is illustrated in FIGS. 5 to 10.

Figure 5:
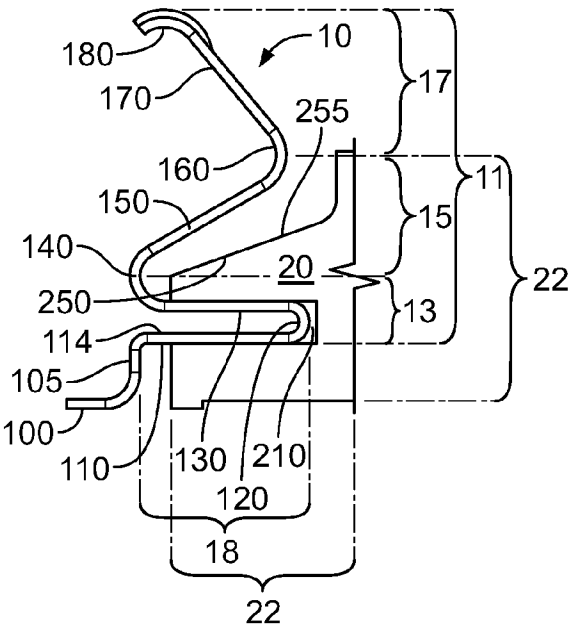
FIG. 5 is a cross-section view of the spring contact device according to the invention before a deformation of a single contact spring.
Figure 10:
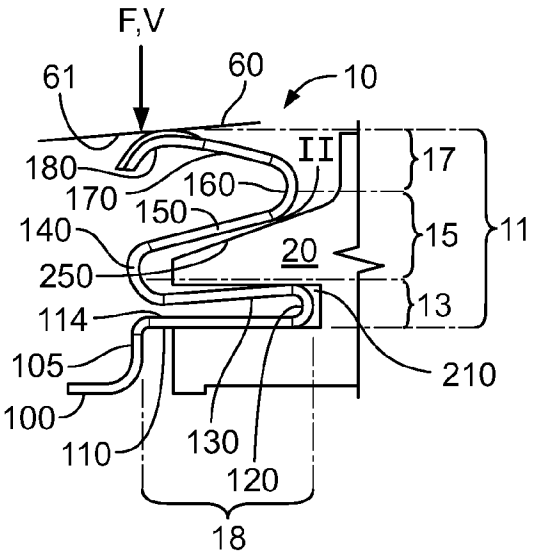
FIG. 10 a cross section view of the spring contact device of FIG. 9, showing a third free resilient portion being deformed when force continues to be applied to the contact spring.
Figure 9:
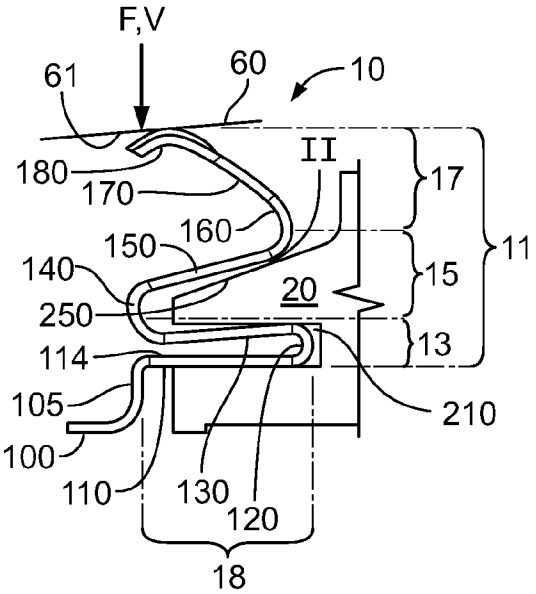
FIG. 9 is a cross section view of the spring contact device of FIG. 8, showing mechanical tensions being reduced in the first resilient portion when force continues to be applied.
Figure 8:
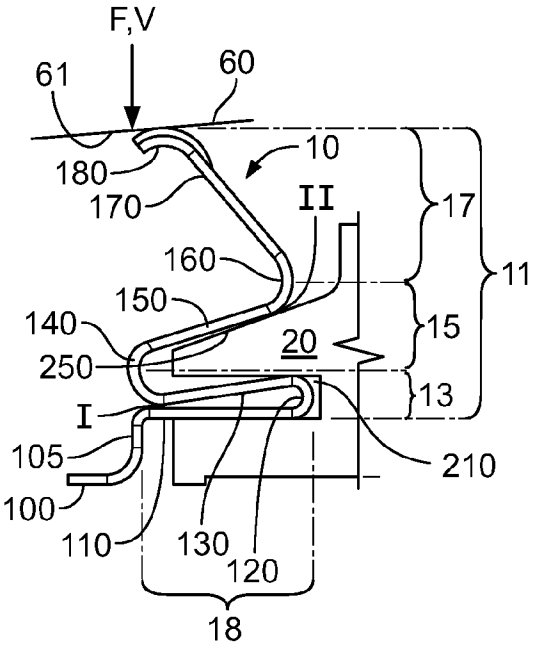
FIG. 8 is a cross section view of the spring contact device of FIG. 7, showing a second resilient portion of the contact spring additionally coming to rest when force continues to be applied.

Below, a force F acts on the electric contact spring 10 in the distortion direction V, the compression direction V, deformation direction V or actuation direction V thereof, the force F increasing from zero "0" (see FIG. 11) in FIG. 5 substantially to the maximum in FIG. 10. FIG. 11 clarifies in this regard in a qualitative manner the mechanical tensions σ of the contact spring 10 which occur in the respective portions 100, 110, 120, 130, 140, 150, 160, 170, 180, a region which is highlighted in bold in the overview table clarifying in a qualitative manner an effect of the invention. The sign "+" in the overview table cannot be associated with any fixed value but instead is simply intended to clarify a mean mechanical loading of the respective portion 100, 110, 120, 130, 140, 150, 160, 170, 180 which, if it increases or falls significantly from one Figure to the next, is clarified by "+" being added or removed.

Figure 6:
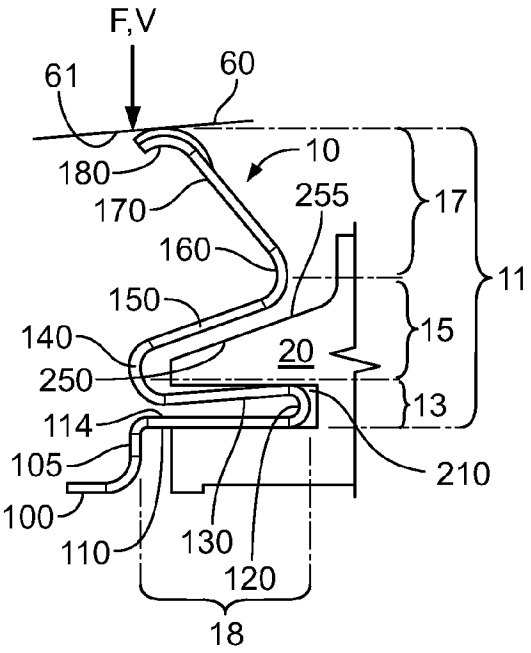
FIG. 6 is a cross section view of the spring contact device of FIG. 5, after initial deformation of an entire resilient portion of the contact spring when a force is applied to the contact spring.

The electric contact spring 10 is constructed in the shown embodiment in such a manner that, in the event of an initial loading of the contact spring 10, the entire resilient portion 11 of the contact spring 10 is deflected in a substantially uniform manner, the mechanical tensions σ in the respective bending portions 120, 140, 160 increasing to a greater extent than in the resilient portions 130, 150, 170 (see FIGS. 6 and 11).

The electric contact spring 10 according to the invention is further constructed in such a manner that, when the force F on the contact spring 10 increases, a first or internal stop zone I is arranged or formed inside the contact spring 10, the second bending portion 140 and/or the first resilient portion 130 moving into abutment against a stop 114 on the assembly portion 110 of the contact spring 10. A resilient movement primarily of the first resilient portion 13 thereby stops, whereby the mechanical tensions σ no longer increase if the force F continues to increase. Until the first stop zone I is established, there is a substantial increase of the mechanical tensions σ primarily in the respective bending portions 120, 140, 160 (see FIGS. 7 and 11).

If the force F continues to increase, mainly only the second resilient portion 15 and third resilient portion 17 of the electric contact spring 10 become deflected, whereby the mechanical tensions σ in the portions 100, 110, 120, 130 remain substantially constant until the second or external stop zone II is reached. To this end, the contact spring 10 and the retention member 20 are constructed in such a manner that the third bending portion 160 and/or the second resilient portion 150 move into abutment against a stop 255 (see also FIGS. 1 and 2) on the abutment face 250 of the retention member 20. The second resilient portion 15 of the contact spring 10 thereby primarily also comes to rest, whereby the mechanical tensions σ also no longer increase in this instance if the force F continues to increase. Until the second stop zone II is established, there is a significant increase of the mechanical tensions σ primarily in the respective bending portions 140, 160 (see FIGS. 8 and 11).

If the force F continues to increase, primarily only the third resilient portion 17 of the electric contact spring 10 becomes deflected, the mechanical tensions σ in the portions 100, 110, 120, 130, 140, 150 remaining constant (100, 130, 150) or even decreasing (110, 120, 140). In this instance, the second stop zone II may move between the third bending portion 160 and the second resilient portion 150 and the abutment face 250 of the retention member 20 with respect to the inclined abutment face 250. If, for example, an electric contact face 61 of the counter-contact device 60 is arranged in such an inclined manner with respect to the deformation direction V of the contact spring 10 or if the force F engages in such an inclined manner on the electric contact portion 180 that the stop zone II moves the inclined abutment face 250 upwards, the second bending portion 140 or the first resilient portion 130 can move away from the assembly portion 110 again (FIG. 9), whereby the mechanical tensions σ in the first bending portion 120 and in the second bending portion 140 may decrease (see FIGS. 9 to 11).

In this instance, there is a significant increase of the mechanical tensions σ in the bending portion 160 which remain at a high level. According to the invention, the electric contact spring 10 is constructed so as to comply with loads, the electric contact portion 180 being constructed in a rigid manner at one side by means of the crimped portion 182. High levels of mechanical tensions σ further occur in the transition from the contact portion 180 to the third resilient portion 170 and from there to the transition of the third bending portion 160 to the second resilient portion 150. The transition from the contact portion 180 to the third bending portion 160 is strengthened by means of the crimped portion 182 which extends into the third resilient portion 170. The third resilient portion 170 is further constructed so as to increase in terms of its width B in order to be able to compensate for the mechanical tensions σ which occur, the third bending portion 160 also having a comparatively large width B.

The stop zones I, II are arranged in this instance in such a manner that a primary movement stop takes place, an additional substantial deformability of the electric contact spring 10 being brought about "elsewhere". In this instance, a bearing or counter-bearing of the contact spring 10 in the retention member 20 is not intended to be a stop in the context of the invention. It is notable in the construction of the electric contact spring 10 that, in the contact portion 100 for electrically contacting the substrate 40, the mechanical tensions σ in all forces F which occur when the contact spring 10 is used in accordance with provisions are substantially zero, whereby solder contact arrangements which are provided there have a high level of durability.

Other embodiments of electric spring contact devices 1 can naturally be used. It is, for example, possible to adjust only the first stop zone I or only the second stop zone II for the contact spring 10. On the other hand, the electric contact spring 10 and the retention member 20 may be constructed in such a manner that firstly a second stop zone II and afterwards a first stop zone I is formed. Generally, the electric contact spring 10 and the retention member 20 may be constructed in such a manner that a single stop zone I/II or any combination of stop zones I, II can be provided; that is to say, more than two (I,I; I,II; II,I; II,II) stop zones I, II may also be used.

Figure 12:
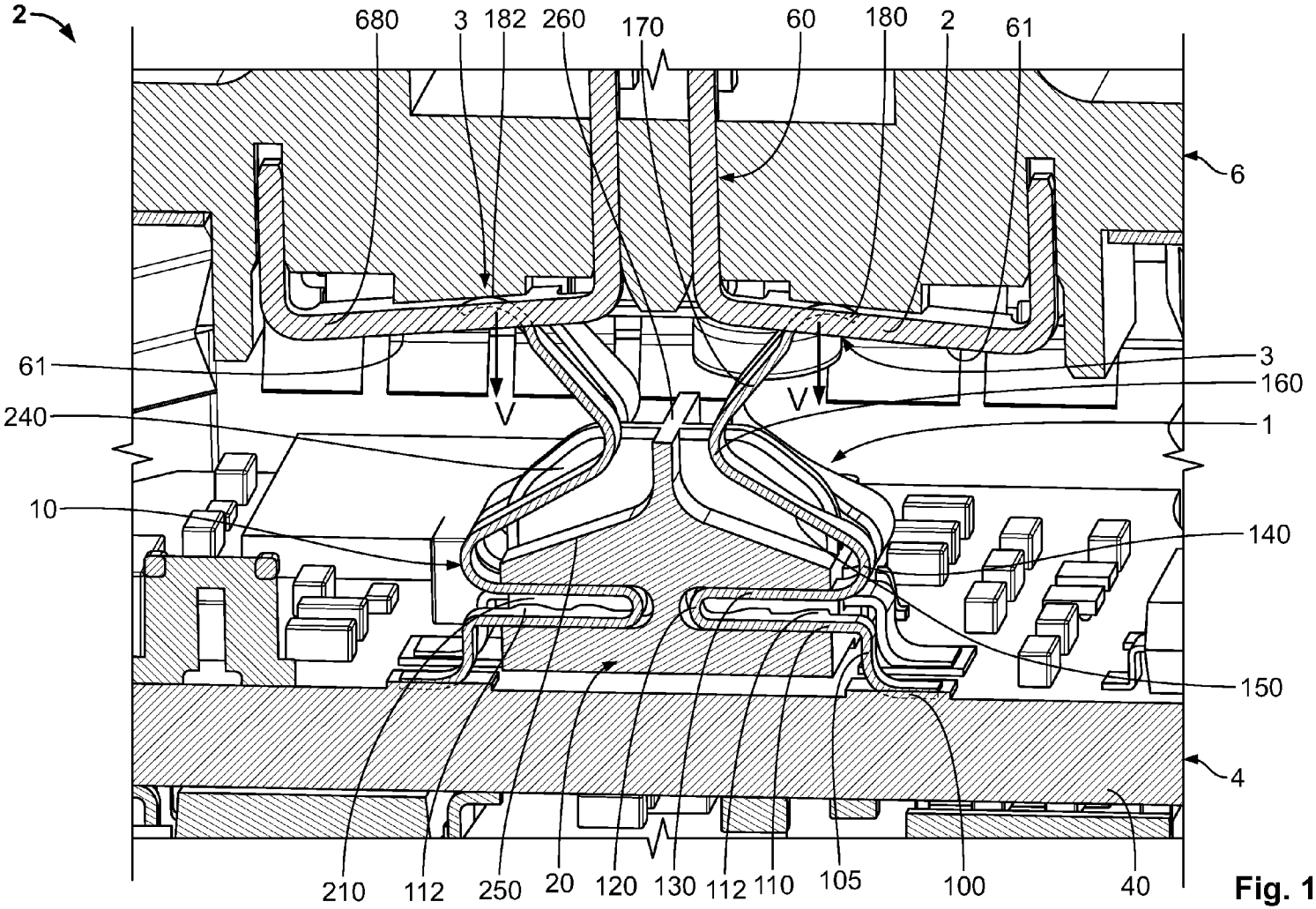
FIG. 12 is a perspective cross-section view of showing connection of the spring contact device with another device.

With respect to FIG. 12, an electric or electronic contact zone 3 in which an electric contact portion 180 of a contact spring 10 and a counter-contact device 60 are connected in an electrically conductive manner is shown. A deformation or movement direction, in particular an initial deformation and/or initial movement direction of the contact spring 10 or the contact portion 180 thereof is in many embodiments of the invention in some cases highly dependent on a friction coefficient between the contact portion 180 and the counter-contact device 60. According to the invention, an angled contact zone 3 is used in preference to a horizontal contact zone 3, a deformation of the contact spring 10 being able to be influenced by means of an angular position of an inclined abutment of the electric contact face 61 of the counter-contact device 60.

In this instance, an individual contact spring 10 and/or an individual counter-contact device 60 are constructed in such a manner and/or arranged in a respective device 4, 6 in such a manner that an electric contact face 61 or an electric contact portion 680 of the counter-contact device 60 is positioned in an inclined or oblique manner on the contact portion 180. That is to say, the contact face 61 or the contact portion 680 is arranged in an inclined or oblique manner with respect to an at least initial distortion direction V, compression direction V, deformation direction V and/or actuation direction V of the contact spring 10 and is thus not horizontal with respect thereto. That is to say that the contact face 61 or the contact portion 680 is also arranged in an inclined or oblique manner at least with respect to a part-portion of a distortion path V, compression path V, deformation path V and/or actuation path V of the contact spring 10.

In this instance, the shown embodiment of the invention for the contact face 61 to engage on the electric contact portion 180 of the contact spring 10 in such a manner that the contact portion 180 and consequently also the contact spring 10 are moved in the direction of the retention member 20. A kinematically inverted embodiment (not illustrated in the drawings) can naturally be used. That is to say, according to the invention, a location or a region of a deformation of a (third) resilient portion (170) and optionally other regions is determined by the inclination or the angle of the contact face 61 of the counter-contact device 60 and is no longer contingent as in the prior art. Since, in this instance contact springs 30 arranged "back to back" in pairs are arranged on/in the retention member 20, the contact faces 61 which are arranged correspondingly are not parallel with each other but instead form an angle with respect to each other, which may be an obtuse angle.

In embodiments of the invention, the electric contact spring 10 and/or the retention member 20 of the electric spring contact device 1 is constructed in such a manner that the contact spring has comparatively high static friction in the first and/or second stop zone and/or the contact spring 10 and the retention member 20 may be constructed in such a manner that the contact spring 10 has comparatively low sliding friction with respect to the retention member 20 in the second stop 114 zone. According to the invention, the retention member 20 may be constructed as an open housing 20, the retention member 20 is constructed in such a manner that the contact springs 10 can be mounted therein/thereon from the outer side. In this instance, the retention member 20 may not have any soldering connection 100 or may not have any soldering faces. The contact spring 10 and/or the retention member 20 or the electric spring contact device 1 is constructed as a component 2 which can be mounted on the surface.

Using the electric contact spring 10 which is constructed according to the invention or the electric spring contact device 1 constructed according to the invention, it is possible in small and extremely small installation spaces to provide a sufficiently great resilient path so that mechanical tolerances—taking into account relaxation or ageing, changes of temperature and optionally an increase in the mechanical tolerances owing to intensive loading—can be compensated for with at least a minimum contact normal force being maintained. Owing to the division of the contact spring 10 according to the invention into one or more resilient portions 13 which function primarily independently of each other, it is possible, with a comparatively long resilient path, to limit mechanical tensions which occur on/in the contact spring 10 by means of one or more stops and optionally during increasing deformation of the contact spring 10 even to reduce them in a region.

The spring contact device 2 can be readily mounted on a substrate 40, the quality of an electrical connection of the respective contact spring 10 to the substrate 40 being able to be readily verified in embodiments of the invention, which can be carried out, for example, by means of automatic optical inspection (AOI) using a single camera, whereby an increase in the production quality is achieved. There is thereby produced an operationally reliable electrical contacting with a low subsequent likelihood of failure of the spring contact device 2. This is also promoted by the fact that, according to the invention in the entire deformation region in accordance with provisions, substantially no forces act on the substrate 40 using the contact spring 10. The invention can be used on all spring contact connections, with the installation spaces in particular being able to be small and the tolerances comparatively large.

The foregoing illustrates some of the possibilities for practicing the invention. Many other embodiments are possible within the scope and spirit of the invention. The reports shown in the specification are merely exemplary embodiments and the spirit of the invention incorporates a custom report having the details listed above. It is, therefore, intended that the foregoing description be regarded as illustrative rather than limiting, and that the scope of the invention is given by the appended claims together with their full range of equivalents.

What is claimed is:

1. An electric contact spring comprising:

a resilient section having a first resilient portion, a second resilient portion extending from the first resilient portion, and a third resilient portion extending from the second resilient portion;

a rigid electrical contacting portion extending from the third resilient portion;

an assembly portion extending from the first resilient portion and having a catch device; and a transition portion extending downward from the assembly portion.

2. The electric contact spring according to claim 1, further comprising a contact portion extending from the transition portion and stepped from the assembly portion.

3. The electric contact spring according to claim 2, wherein the assembly portion and the first resilient portion, the second resilient portion and the third resilient portion move back and forth above the transition portion through a plurality of bending portions.

4. The electric contact spring according to claim 3, wherein the plurality of bending portions includes a first bending portion connecting the first resilient portion and the assembly portion.

5. The electric contact spring according to claim 4, wherein the plurality of bending portions includes a second bending portion connecting the first resilient portion and the second resilient portion.

6. The electric contact spring according to claim 5, wherein the plurality of bending portions includes a third bending portion connecting the second resilient portion with the third resilient portion.

7. The electric contact spring according to claim 6, wherein the plurality of bending portions includes a fourth bending portion connected to the third resilient portion, and forming the rigid electrical contacting portion.

8. The electric contact spring according to claim 7, wherein the plurality of bending portions have a constant width.

9. The electric contact spring according to claim 7, wherein the second bending portion is wider than the first bending portion.

10. The electric contact spring according to claim 9, wherein the third bending portion is wider than the first bending portion.

11. The electric contact spring according to claim 9, wherein the rigid electrical contacting portion and the third resilient portion are wider than the second resilient portion.

12. The electric contact spring according to claim 1, wherein the first resilient portion is a leaf spring.

13. The electric contact spring according to claim 1, wherein the first resilient portion is a resilient arm.

14. The electrical contact spring according to claim 1, wherein the rigid electrical contacting portion includes a crimp, projection, or reinforcement rib on an outer surface.

* * * * *